United States Patent [19]

Darche

[11] Patent Number: 4,843,996

[45] Date of Patent: Jul. 4, 1989

[54] SYSTEM FOR EXPLORING AND OBSERVING SUBAQUATIC BEDS FOR A SUBMARINE DEVICE AND FOR CONTROLLING SAME

[75] Inventor: Michel J. P. Darche, Ville d'Avray, France

[73] Assignee: Societe ECA, France

[21] Appl. No.: 191,283

[22] Filed: May 6, 1988

[30] Foreign Application Priority Data

May 7, 1987 [FR] France ..... 87 06464

[51] Int. Cl.[4] ..... B63G 8/14

[52] U.S. Cl. ..... 114/245

[58] Field of Search ..... 114/244, 245; 367/106

[56] References Cited

U.S. PATENT DOCUMENTS 3,086,490 4/1963 Nichols ..... 114/244

3,105,453 10/1963 Hayes ..... 114/244

3,987,745 10/1976 Chaverebiere et al. ..... 367/106

*Primary Examiner*—Joseph F. Peters, Jr.

*Assistant Examiner*—Jesûs Sotelo

*Attorney, Agent, or Firm*—McGlew & Tuttle

[57] ABSTRACT

In this system, which is of the type comprising at the end of a primary cable (3), a first fish (5) to which is connected a secondary cable (7) towed by a second fish, there are provided, in proximity to the first fish (5), apparatus (18) for measuring the angle between the direction of the relative current and the vertical plane passing through the secondary cable (7), and apparatus for measuring the angle of inclination of the secondary cable (7) to the horizontal, connected to apparatus for automatically steering the second fish so as to bring said angles to predetermined values.

22 Claims, 3 Drawing Sheets

SYSTEM FOR EXPLORING AND OBSERVING SUBAQUATIC BEDS FOR A SUBMARINE DEVICE AND FOR CONTROLLING SAME

The technical field of the invention is that of submarine devices which are supplied with electrical power through a cable, currently termed "umbilical cable", by a ship on the surface of the water.

There is known from applicant's U.S. Pat. No. 3,987,745 a system for exploring and observing subaquatic beds by means of "fishes" or vessels towed by means of cables by a ship, comprising at the end of a primary supporting and towing cable a first "fish" or vessel which is automatically stabilized in height relative to the bed and, extending from this first fish, a secondary cable towed by a second automotive "fish" or vessel which is likewise stabilized, steerable at a distance and carries detection instruments, the primary cable being a towing cable and the two cables, which transmit power produced on the ship, signals for the remote-control of the second fish, and detection signals coming from the latter and thus returning to reading apparatus on board the ship.

This arrangement considerably improves the submersion and speed performances of such a system with respect to the water.

The first fish, also termed "depressor", is attached at a point of the umbilical cable and is used to stretch out in the downward direction the section of cable between the ship and the depressor by the effect of its hydrodynamic lift and/or its apparent weight in the water. The section of cable extending between the ship and the depressor is also termed "tow".

The section of cable extending between the depressor and the second fish, also termed "principal vessel", may then be roughly rectilinear and horizontal and extend in the direction of displacement of the system in the water. The section of cable between the depressor and the principal vessel is also termed "leash".

The principal vessel may therefore tow the whole of the system with a very small effort, even when this device must move far ahead of the ship.

Furthermore, a winch installed either in the principal vessel in accordance with the aforementioned patent, or in the depressor in accordance with the French certificate of addition No. 75/29,116 of the applicant, enables the useful length of the leash, and therefore the longitudinal position of the principal vessel relative to the depressor, to be varied.

However, this system has a number of drawbacks. Indeed, when a force, generally a hydrodynamic force, is applied to the principal vessel, transversely of the leash, i.e. vertically or laterally, hydrodynamic forces due to the speed relative to the water act on the leash and bend it and increase the transverse dispacement of the principal vessel and cause it to move rearwardly.

This transverse force may be intentionally applied to the principal vessel in order to shift it transversely as indicated in the aforementioned patent, or unintentionally, owing to the lack of precision in the adjustment of the transverse force by means of ballast, guide elements or propellers, with very harmful effects.

The object of the invention is therefore to overcome these problems.

The invention therefore provides a system of the previously-described type, wherein means are provided in proximity to the first fish for measuring the angle between the direction of the relative current and the vertical plane passing through the secondary cable, said measuring means being connected to means for automatically steering the second fish so as to bring this angle to a predetermined value.

According to another feature of the invention, the system comprises in proximity to the first fish means for measuring the angle of inclination of the secondary cable to the horizontal, said measuring means being also connected to the automatic steering means of the second fish so as to bring this angle to a predetermined value.

According to a further feature of the invention, the first and second fishes comprise means for measuring their depth of submersion, said means being also connected to the automatic steering means of the second fish so as to bring the difference of depth of submersion of the two fishes to a predetermined value. Advantageously, these predetermined values are equal to zero.

The automatic steering means of the second fish therefore receive data enabling them to control the propellers and the guide elements of the second fish so as to bring the aforementioned various values to their set values.

Thus, the leash remains rectilinear generally in the plane passing through the ship, the tow and the depressor and in a horizontal plane.

This device renders the system stable with respect to the disturbing transverse forces exerted on the principal vessel. A winch on board the ship permits by paying out or taking in the tow, increasing or reducing the depth of submersion of the depressor and therefore that of the principal vessel by various measuring means and automatic steering means.

Further, another winch may also be provided on the depressor or on the principal vessel, this winch permitting by paying out or taking in the leash, advancing or moving back the principal vessel relative to the depressor and the ship.

However, it is then no longer possible to shift the principal vessel laterally by action on its guide elements or its lateral propellers as is possible in the aforementioned U.S. Pat. No. 3,987,745.

To overcome this drawback, the first fish comprises roll control means. When the depressor is inclined laterally, its hydrodynamic lift acquires a lateral component which laterally deviates the lower end of the tow and the depressor. The principal vessel then deviates laterally to the same extent as the depressor owing to the various measuring means and automatic steering means.

Furthermore, the winch installed on the depressor or on the principal vessel constitutes voluminous, delicate and expensive equipment.

This winch may be dispensed with by providing a tube which is attached in an articulated manner to the primary cable above the first fish and in which the second cable slides, the end of the latter forming a loop and being attached to the first fish.

This loop is held taut either by the relative current, or by means which are provided for this purpose and will be described in more detail hereinafter, so that a disturbing transverse force on the principal vessel does not result in an excessive curvature of the leash just ahead of the tow and an excessive transverse deviation of the principal vessel.

The tension-applying means for the loop may be for example formed by a pulley around which the loop passes, this pulley being rotatively mounted between two arms fixed to a body having a high hydrodynamic drag, such as a plate parallel to the axis of rotation of the pulley.

By varying the thrust of the longitudinal propeller or propellers of the principal vessel, it is then possible to advance or move back the principal vessel relative to the depressor and/or the ship by a sliding of the leash in the tube.

The following description with reference to the accompanying drawings given by way of a non-limitative example will explain how the invention may be put into effect.

Figure 1:
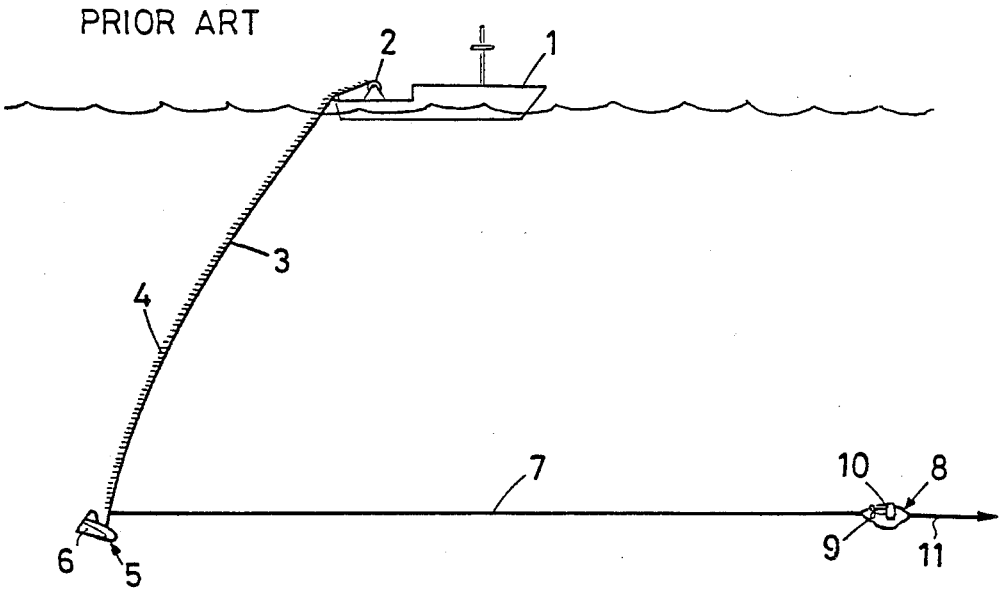
FIG. 1 represents an exploring and observing system of the prior art.

As represented in FIG. 1, which shows a utilization at sea of the main components described in U.S. Pat. No. 3,987,745, a ship 1 carries a winch 2 whereby a primary cable 3, which will also be termed "tow" hereinafter, is paid out or hauled in.

This tow is provided, for example, with faired bodies, hairs or ribbons 4 which reduce its hydrodynamic drag and enable it to plunge more deeply into the sea notwithstanding the speed of forward travel of the ship and that of the contrary current, owing to the downward pull exerted by a first fish or vessel 5 which will also be termed a "depressor", attached to the end of this tow.

This pull is obtained either by the effect of the apparent weight in water of this depressor 5 or by that of the downward negative hydrodynamic lift due to one or more wings 6 provided on this depressor, or more generally by a combination of these two effects.

Note that this depressor may be devoid of its own means of propulsion.

Attached to the lower part of the tow 3 or to the depressor 5, is a secondary cable 7, also termed "leash", at the front end of which there is fixed a second fish or vessel 8 which will also be termed "principal vessel".

The primary and secondary cables include electrical power supply conductors of the principal vessel 8 and for the transmission of various data.

The secondary cable may be smooth and advantageously possess a slightly positive buoyancy so that, when it is in equilibrium in the current and rectilinear, it extends slightly downwardly from the depressor.

The principal vessel 8 is equipped with various components not shown in this Figure, such as cameras, sonar, remote-controlled manipulating arms or releasable loads required for the accomplishment of its various missions at sea.

This device further comprises one or more longitudinal and transverse propellers 9 and 10 and/or guide elements, of known type, which enable it to move for example transversely with respect to the leash, i.e. vertically or laterally.

Note that a transverse force may be obtained by the hydrodynamic lift of the device owing to its inclination relative to the current, this inclination being itself obtained by a differential thrust from two parallel propellers.

This principal vessel 8 may also include a winch (not shown) with a rotating electrical contact, whereby it is possible to vary the effective length of the secondary cable or leash, i.e. it is possible to advance or move back this device with respect to the depressor 5 and consequently to the ship 1.

The electrical power supply and the various signals required for the operation of the propellers and the various equipment the principal vessel 8 is provided with pass through the aforementioned rotating electrical contact, the leash 7, the tow 3 and a rotating electrical contact of the winch 2 to the ship 1 where there are provided a control station and an electrical power supply ensuring the operation of the whole of the system.

As explained in the aforementioned patent, the use of the depressor 5 permits reducing the power required by the principal vessel 8 for holding the leash 7 taut in rectilinear equilibrium relative to that which would be necessary if there were only a single curved cable between the principal vessel 8 and the ship 1.

FIG. 1 illustrates the behavior of the system when a longitudinal pulling force 11 is applied on the vessel 8 relative to the leash 7.

Figure 2:
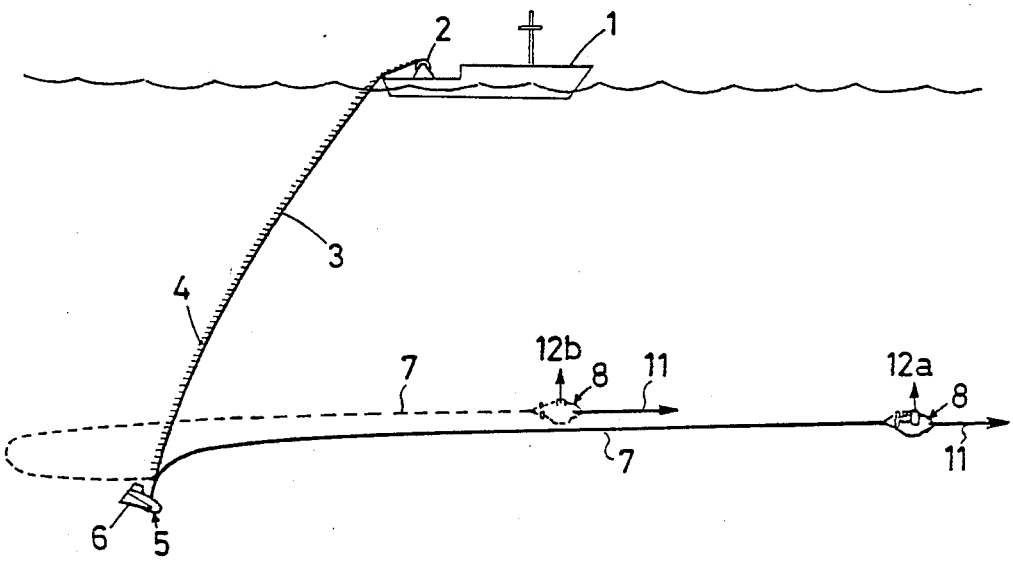
FIG. 2 illustrates the effect of a transverse force applied to the principal vessel which is part of the arrangement of a system of the prior art.

In FIG. 2, a transverse force is also applied on the vessel 8 in addition to this longitudinal force.

This transverse force may be due to a variation in the apparent weight of the principal vessel 8 or of the hydrodynamic effect of guide elements or transverse propellers or to hydrodynamic dissymmetry. FIG. 2 represents a vertical force, but it will be understood that the same result will be obtained with a lateral force.

For a low value, 12*a*, of this force, the leash bends in the relative current and the vessel 8 becomes transversely deviated. Note that the angle made by the leash with its initial position and its curvature are maximum in proximity to its point of attachment to the tow.

When the transverse force increases, as at 12*b*, the angle and the curvature increase more and more rapidly, then the leash forms a loop at the rear of the tow. The vessel 8 then continues to deviate transversely and it moves back to an increasing extent.

The manner in which these phenomena occur is such that the transverse force cannot be used for steering the vessel 8 and, for example, laterally deviating it, i.e. in a direction perpendicular to the plane of the Figure as was indicated in the aforementioned U.S. patent. Indeed, the least imprecision around the value of the transverse force which would be necessary, results in uncontrollable movements of the vessel.

Figure 3:
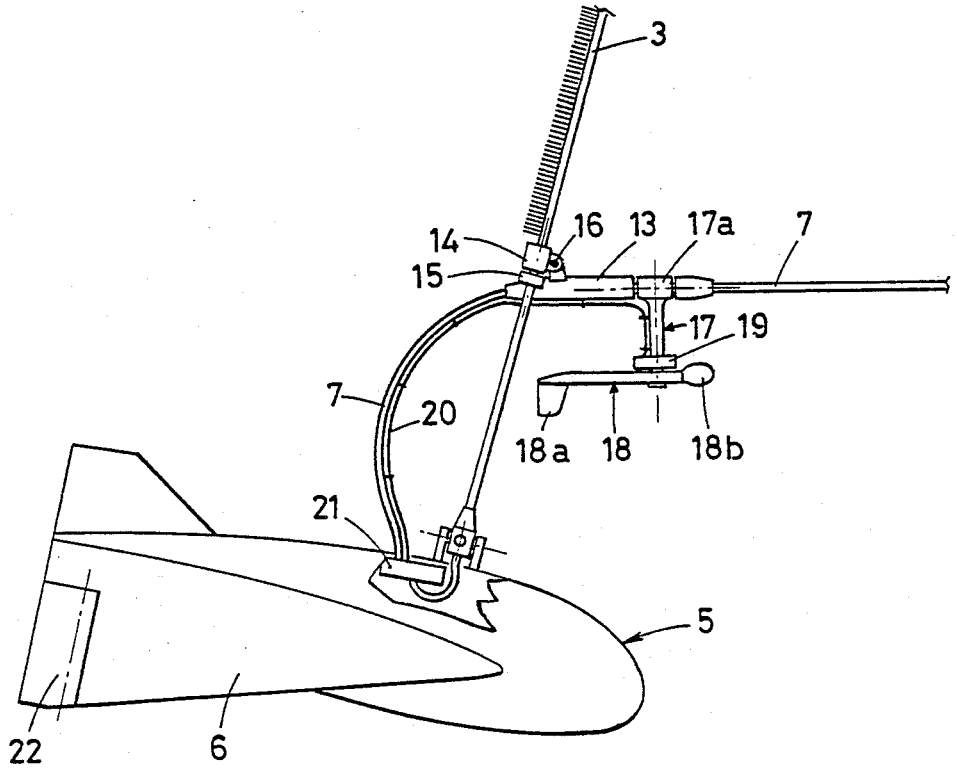
FIG. 3 represents a first embodiment of a depressor which is part of the arrangement of a system according to the invention.

The system according to the invention, the depressor 5 of which is shown in FIG. 3, comprises a rigid tube 13 to which the leash 7 is fixed. The end of the leash is fixed to this depressor 5. A bush or sleeve 14 is rotatively mounted on the tow 3 where it is maintained in position by one or two collars 15 so as to avoid a sliding thereof.

A pin 16 extending through a lug carried by the bush 14 and another lug carried by the tube 13 constitutes an articulation having two degrees of freedom between the tow 3 and the leash 7. It will be understood that other embodiments of this articulation may be envisaged.

At the rear of the articulation, the leash forms a loop in order to allow all its flexibility to the articulation and it is electrically connected to the depressor as will be described in more detail hereinafter.

A heavy arm 17 is mounted to pivot about the tube 13 by a bush or sleeve 17*a* so that its axis remains roughly in a vertical plane. Disposed at its lower end is a hydrodynamic vane 18 mounted to be rotatable about the axis of the arm.

The vane 18 includes in the known manner, in its rear part, a vertical fin 18*a* and, in its front part, a balancing counterweight 18*b*. The angle made by the vane, i.e. substantially the direction of the local current, with the roughly vertical plane passing through the leash 7 and the arm 17, is measured by an electrical angle detector disposed for example in a housing 19 of the arm.

It will be understood that this vane could be replaced by any other known measuring device enabling this angle to be measured, as for example, by a manometric antenna with a pressure sensor or a sensitive head mounted on a strip having stress gauges.

The electrical signal of the detector passes through a cable 20 connected for example in succession to the arm 17, the tube 13, and the leash 7 and electrically connected to this leash and/or to the tow, preferably in a housing 21 contained in the depressor 5.

The signal is thereafter used in the known manner in automatic steering means for the principal vessel 8, of known type, for controlling the guide elements or lateral propellers of the latter, so that, close to the tow, the leash 7 and the direction of the current are maintained for example in the same vertical plane.

The device further comprises, still in proximity to the first fish or depressor 5, means for measuring the angle of inclination of the leash 7 to the horizontal. These means are, for example, formed by an electrical attitude or tilt detector such as a pendulum or an accelerometer within the housing 19 which measures the angle made by the arm 17 with respect to the vertical.

Furthermore, the depressor 5 and the principal vessel 8 may also include means for measuring their depth of submersion. The detector of the depressor 5 may be disposed for example in the arm 17.

The vane 18 having one axis may also be replaced by a vane having two axes comprising in its rear part a horizontal additional fin, an articulation having two axes of the universal joint type at the lower end of the arm 17, and, on each axis, an electrical angle detector.

However, this vane may be replaced by any other detector of the angle of incidence and dragging of known type.

The electrical signals delivered by these various measuring means pass through the cable 20 to the depressor 5 whence they are conducted to the automatic steering means preferably disposed in the principal vessel 8, for controlling the guide elements and/or the propellers of the latter in such manner that:

the angle made by the leash 7 and the projection of the direction of the relative current onto the vertical plane passing through the leash close to the tow, the angle made by the leash and the horizontal plane close to the tow, and the difference of depth of submersion between the depressor 5 and the principal vessel 8, are maintained at predetermined values which are for example equal to zero.

The depressor 5 comprises, as mentioned before, roll control means formed for example by guide elements 22 provided on the trailing edges of the wings 6 of the depressor. These guide elements are for example actuated by an electrical jack controlled from the ship.

This control permits, as explained before, inclining the depressor 5 and, in response, displacing the principal vessel 8.

In this case and in an end elevational view of the system along the axis of displacement in the water, the tow no longer appears to be vertical but oblique and slightly downwardly curved. The arm 17 remains vertical owing to its weight and its articulation to the tube 13. Owing to the vane 18 and possibly to the attitude detector or to the submersion detectors acting on the guide elements and/or the transverse propellers of the vessel 8, the leash remains in the vertical plane containing the tube 13 and the arm 17 close to the depressor 5 with possibly a slight difference of submersion between the two fishes which remains unchanged, the leash remaining roughly rectilinear and demanding a low pulling effort from the vessel 8.

Figure 4:
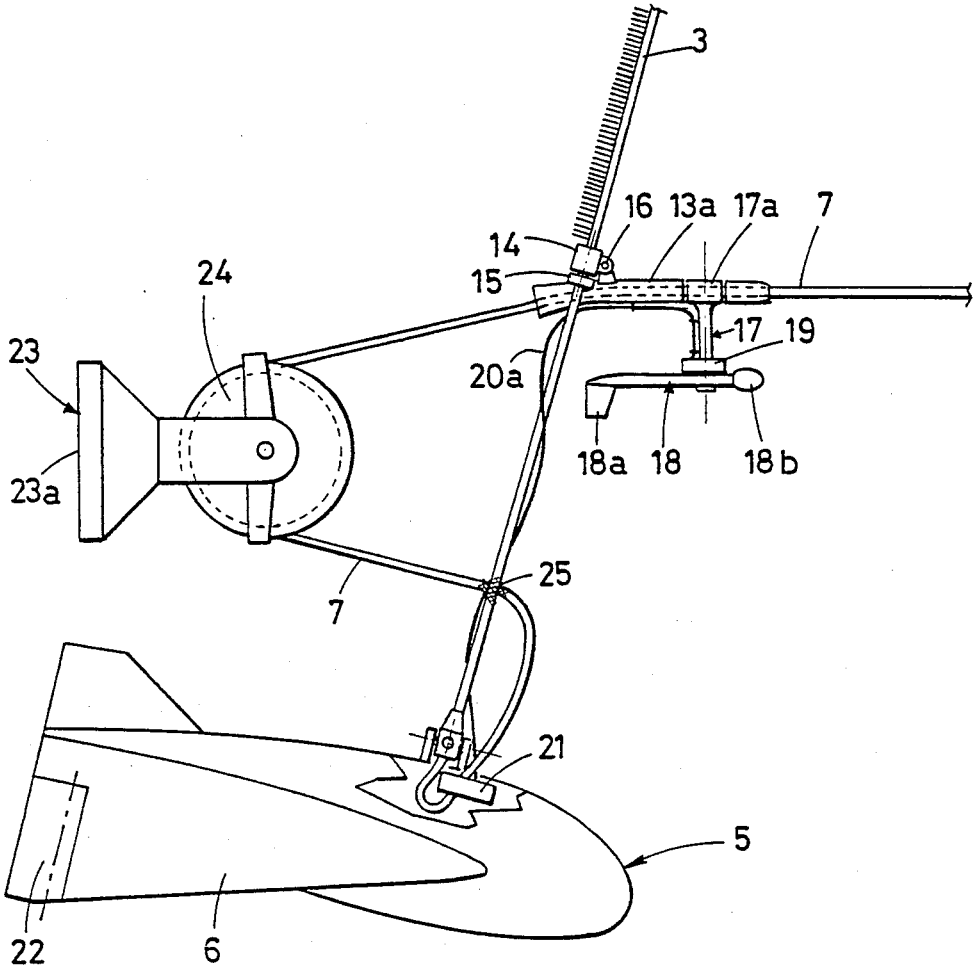
FIG. 4 represents a second embodiment of a depressor which is part of the arrangement according to the invention.

In the embodiment represented in FIG. 3, the leash 7 is fixed to the tube 13. However, and as represented in FIG. 4, the leash 7 may also be slidably mounted in a tube 13*a*. This tube then advantageously includes guide rings at each of its ends.

A hydrodynamic tension-applying device 23 may then be provided for maintaining the leash 7 under tension. The tension device, which has an apparent weight in water which is roughly nill, comprises for example a circular plate 23*a* mounted at the rear of a cone which thus imparts to the tension device both a high hydrodynamic drag and a high hydrodynamic stability.

The front part of the tension device in the form of a fork includes two arms between which is rotatively mounted a pulley 24 having an axis of rotation parallel to the circular plate. The leash 7 extends around this pulley and guide means may be provided for preventing the leash from jumping from the pulley.

The leash is fastened to the tow, for example at 25, at a point located below the tube 13*a*, in a flexible and articulated manner with no possibility of sliding.

The end of the leash is electrically connected to the arm of the tow, preferably in the housing 21, a signal transmission cable 20*a* being fixed to the tow 3 and connected to this housing 21.

The leash 7 has a certain tangential drag per unit length and it is possible to vary the length it occupies from the pulley 24 to the vessel 8 by varying the longitudinal pulling force 11 exerted by the vessel 8 on the leash.

The pulling force is smaller in the region of the tube 13*a*, but, owing to the tension-applying means 23, it always remains sufficiently large. Notwithstanding the imprecision of the transverse force, the tube 13*a* does not deviate from a large angle relative to the direction of the local current and the leash remains roughly rectilinear.

Thus, by varying the number of turns wound onto the winch 2 on board the ship, the setting of the guide elements 22 of the depressor 5 and the pulling force 11 of the longitudinal propellers 9 of the principal vessel 8, which remains rather small owing to the depressor 5, it is possible to cause the second fish 8, fed through the cable, to navigate in a stable manner within a wide range of speeds relative to the water and of vertical, lateral and longitudinal deviations relative to the ship.

I claim:

1. A system for exploring and observing subaquatic beds employing fishes towed by a ship, said system comprising a primary cable for supporting and towing and having an end, a first fish connected to said end of the primary cable, a secondary cable connected to the first fish, a second fish connected to the secondary cable for towing the secondary cable, said system further comprising, in proximity to the first fish, means for measuring an angle between a direction of the relative water current and a vertical plane passing through the secondary cable, means for automatically steering the second fish and connected to said measuring means in order to bring said angle to a predetermined value.

2. A system according to claim 1, comprising, in proximity to the first fish, second means for measuring a second angle of inclination of the secondary cable to the horizontal, said second measuring means being connected to the means for automatically steering the second fish so as to bring said second angle to a predetermined value.

3. A system according to claim 2, wherein the predetermined value of said second angle is equal to zero.

4. A system according to claim 2, wherein the second means for measuring the angle of inclination of the secondary cable to the horizontal comprise an electrical attitude detector.

5. A system according to claim 1, comprising, in proximity to the first fish, second means for measuring a second angle made by the secondary cable with a projection of the direction of the relative water current onto the vertical plane passing through the secondary cable, said second measuring means being connected to the means for automatically steering the second fish so as to bring said second angle to a predetermined value.

6. A system according to claim 5, wherein the predetermined value of said second angle is equal to zero.

7. A system according to claim 1, wherein the first and second fishes include means for measuring depths of submersion thereof, said submersion measuring means being connected to the means for automatically steering the second fish so as to bring a difference of depth of submersion of the two fishes to a predetermined value.

8. A system according to claim 7, wherein the predetermined value of said difference of depths is equal to zero.

9. A system according to claim 1, wherein the predetermined value is equal to zero.

10. A system according to claim 1, wherein the first fish includes roll control means.

11. A system according to claim 10, wherein the roll control means comprise wings provided on the first fish and having trailing edges, and guide elements provided on said trailing edges.

12. A system according to claim 1, wherein the secondary cable is articulated to the first cable, the corresponding end of the second cable being connected to the first fish by forming a loop.

13. A system according to claim 12, comprising a sleeve rotatively mounted on the primary cable, a tube connected by articulation means to said sleeve, the secondary cable being fixed to the sleeve.

14. A system according to claim 12, comprising a sleeve mounted to be rotatable about the primary cable, a tube connected by articulation means to said sleeve, the secondary cable being slidably mounted in said tube.

15. A system according to claim 14, comprising means for putting the secondary cable under tension.

16. A system according to claim 15, wherein said tension means comprise hydrodynamic tension means.

17. A system according to claim 16, wherein the tension means comprise a body having a high hydrodynamic drag, two arms fixed to said body, a pulley, around which pulley the loop of the secondary cable extends, said pulley being rotatively mounted between said two arms.

18. A system according to claim 17, wherein the high drag body is formed by a plate extending in a direction parallel to the axis of rotation of the pulley.

19. A system according to claim 1, wherein the means for measuring the angle between the direction of the relative current and the vertical plane passing through the secondary cable comprise a heavy support arm which is mounted to be rotatable about the secondary cable, and a hydrodynamic vane mounted at an end of the arm remote from the secondary cable to rotate about an axis.

20. A system according to claim 20, wherein the support arm is mounted to be rotatable about the tube.

21. A system according to claim 19, wherein second means for measuring the angle of inclination of the secondary cable to the horizontal comprise an electrical attitude detector, and wherein the attitude detector is carried by the support arm and measures an angle made by the support arm with the vertical.

22. A system according to claim 19, comprising, in proximity to the first fish, second means for measuring a second angle made by the secondary cable with a projection of the direction of the relative water current onto the vertical plane passing through the secondary cable, said second measuring means being connected to the means for automatically steering the second fish so as to bring said second angle to a predetermined value, the second means for measuring the second angle made by the secondary cable with the projection of the direction of relative water current onto the vertical plane passing through the secondary cable comprising a second axis of rotation of the hydrodynamic vane perpendicular to the first-mentioned axis of rotation.

* * * * *